US007386948B2

(12) United States Patent
Sink

(10) Patent No.: US 7,386,948 B2
(45) Date of Patent: Jun. 17, 2008

(54) FLEXIBLE HINGED CLEAT

(75) Inventor: Jeffrey A. Sink, Redwood City, CA (US)

(73) Assignee: Creative Footwear, Inc., Redwood City, CA (US)

( * ) Notice: Subject to any disclaimer, the term of this patent is extended or adjusted under 35 U.S.C. 154(b) by 604 days.

(21) Appl. No.: 10/959,766

(22) Filed: Oct. 6, 2004

(65) Prior Publication Data

US 2005/0072026 A1 Apr. 7, 2005

Related U.S. Application Data

(60) Provisional application No. 60/509,313, filed on Oct. 7, 2003.

(51) Int. Cl.
*A43B 5/00* (2006.01)

(52) U.S. Cl. ..... 36/127; 36/134; 36/67 D; 36/59 R

(58) Field of Classification Search ..... 36/127, 36/134, 67 R, 59 R, 67 D, 114
See application file for complete search history.

(56) References Cited

U.S. PATENT DOCUMENTS 6,615,512 B2 9/2003 Sink ..... 36/127

*Primary Examiner*—Jila M Mohandesi
(74) *Attorney, Agent, or Firm*—Law Offices of Terry McHugh

(57) ABSTRACT

A flexible hinged cleat for a shoe includes a base, a hinge section and a traction section formed as a one-piece mechanism. The flexible hinged cleat is capable of flexing upwardly or downwardly, depending on the direction of the applied force. The hinge section is configured such that the traction section is hinged for rotation relative to a generally fixed axis. Multiple flexible hinged cleats may be molded as parts of a strip and subsequently sandwiched between the outsole and midsole of a shoe.

20 Claims, 6 Drawing Sheets

FLEXIBLE HINGED CLEAT

CROSS REFERENCE TO RELATED APPLICATION

The present application claims priority from U.S. Provisional Application No. 60/509,313, filed Oct. 7, 2003.

TECHNICAL FIELD

The invention relates generally to cleats and cleating systems for footwear.

BACKGROUND ART

Historically in the golfing industry, golfers have used shoes in which an array of screw holes were embedded into the shoe sole to accept an equivalent number of golf spikes. The golf spike tips are typically made of metal, such as tungsten or stainless steel, and are contained within a circular housing having a nub portion. These spikes are screwed into the screw holes and can be removed or replaced, as needed, using a special golf wrench tool. A standard golf shoe typically has between eight and eleven golf spikes for each shoe. These spikes provide traction for a golfer during a golf swing.

A major problem with these types of golf spikes is that the spikes and the nub portion can leave spike marks on the grass surface of a golf course, particularly on the putting surfaces (called the "green" or the "putting green"). A careless golfer who shuffles or twists his feet while walking across a putting green can damage the grass surface. Even a careful golfer can leave spike marks on a putting green, particularly when the putting green is wet.

Current golf rules permit the repair of golf ball marks on the putting green, such as the mark left when a golf ball hits the putting green. However, those current golf rules do not permit the repair of spike marks. It is well known that the spike marks that golf spikes make on the putting surface can dramatically affect the motion or path of a putted golf ball, and as a result, the golfer's overall score. Many golf courses have subsequently banned the use of traditional spiked golf shoes for these reasons.

Initially, some golf courses permitted the use of certain types of spikeless golf shoes, hoping to minimize the spike marks left by spiked golf shoes. Some versions of those spikeless golf shoes incorporated an array of circular rubber knobs, which were to provide the desired traction similar to the traditional spiked golf shoes, but tended to leave knob marks on the putting greens. In some instances, more severe marks were caused by these types of spikeless golf shoes. As a result, more golf courses have banned the use of the rubber knob type of spikeless golf shoes as well.

There are presently available golf shoes in which circular cleats (typically plastic) replace the traditional golf spikes, again using some form of golf wrench tool to remove the golf spikes and replace those golf spikes with the circular cleats. Each circular cleat typically has a series of pin-like projections or a circular array of triangular shaped nubs, which serve to provide traction during a golf swing. However, these circular types of spikeless golf cleats can still leave undesired marks on the putting surface, particularly in wet conditions. Another problem with these plastic cleats is they can fall out during a round and cause the threaded receptacle to become packed with mud and debris, making it very difficult to clean, so that a new cleat can be installed.

Another problem with existing golf shoes is that the outsole portion (the bottom) of the golf shoe tends to accumulate dirt and debris, especially during wet conditions. The accumulation of such dirt and debris requires frequent and tedious cleaning, as otherwise the desired traction during a golf swing can be affected.

In view of the foregoing, there is a need for an improved spikeless golf shoe which will eliminate or minimize the type of spike marks presently left on the grass surfaces and particularly the putting surfaces, while still providing the necessary traction during a golf swing and minimizing the accumulation of dirt and debris.

SUMMARY OF THE INVENTION

In the preferred embodiment, the flexible hinged cleat of the present invention is comprised of a base, a hinge section and a traction section, formed as a one-piece mechanism. When the hinge section is flexed, the traction section is extended to perform a cleating action. The traction section, when viewed cross sectionally, is substantially triangular in shape, having a first side and a second shorter side. The first side forms a first angle with respect to the base of the cleat and the second shorter side forms a second angle with respect to the base of the cleat. The hinge section is made of a flexible material which varies the first angle and second angle as required to perform the cleating action. A maximum cleating action is achieved when the second shorter side makes contact with the base. The hinge section is also capable of varying the first angle and second angle as required to achieve a walking position in which negligible cleating action is attained. A relaxed position may also be achieved. In the relaxed position, the hinge section is capable of sustaining the first angle and the second angle.

In one embodiment of the invention, a cleating system is provided as an outsole. The outsole has a front sole portion and a heel portion. The front sole portion and heel portion each have a lateral side and a medial side. A plurality of ridges is disposed at an outer periphery of both the lateral and medial sides of both the front sole portion and the heel portion.

A first row of flexible hinged cleats is disposed substantially parallel to the ridges on the lateral side of the front sole portion. A second row of flexible hinged cleats is disposed substantially parallel to ridges on the medial side of the front sole portion. A third row of flexible hinged cleats is disposed substantially parallel to the ridges on the medial side of the heel portion. Each of the flexible hinged cleats of the cleating system is configured to provide a cleating action. The cleating system also provides that when each flexible hinged cleat is in a walking position, negligible cleating action is occurring; thereby a putting surface is not altered. The cleating system is also configured such that each flexible hinged cleat can attain a relaxed position in the absence of an applied force.

This embodiment of the invention may also provide that a plurality of weight bearing structures is disposed amid the ridges of the front sole portion and heel portion. These weight bearing structures provide support when the flexible hinged cleats are in a walking or in a relaxed position. The support extends the life and durability of the flexible hinged cleats when walking on hard surfaces, such as asphalt or pavement. The durability is extended because the flexible hinged cleats do not extend beyond the apex of the weight bearing structures.

In another embodiment of the invention, a method of forming a spikeless golf shoe is provided. The method provides a midsole, flexible hinged cleat strips and an outsole. The midsole has a front sole portion and a heel portion. Both the front sole portion and heel portion have a lateral side and a medial side. The midsole is formed with cavities on the front sole portion lateral and medial sides and on the heel portion medial side. Each of the cavities is configured to accept a flexible hinged cleat strip. Each flexible hinged cleat strip is a unitary structure having a substructure formed with a plurality of flexible hinged cleats. The flexible hinged cleat strips are molded into a front sole lateral strip, a front sole medial strip and a heel medial strip by a means known to those of ordinary skill in the art. The present invention also provides an outsole configured to fit atop the midsole in a manner that allows each flexible hinged cleat to protrude through the outsole when the flexible hinged cleat strips are inserted into their respective cavities.

BRIEF DESCRIPTION OF THE DRAWINGS

The accompanying drawings, which are incorporated in and form a part of this specification, illustrate embodiments of the invention and together with the description, serve to explain the principles of the invention.

DETAILED DESCRIPTION

Referring now to the accompanying drawings, reference will now be made in detail to the preferred embodiments of the invention. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention.

Figure 1A:
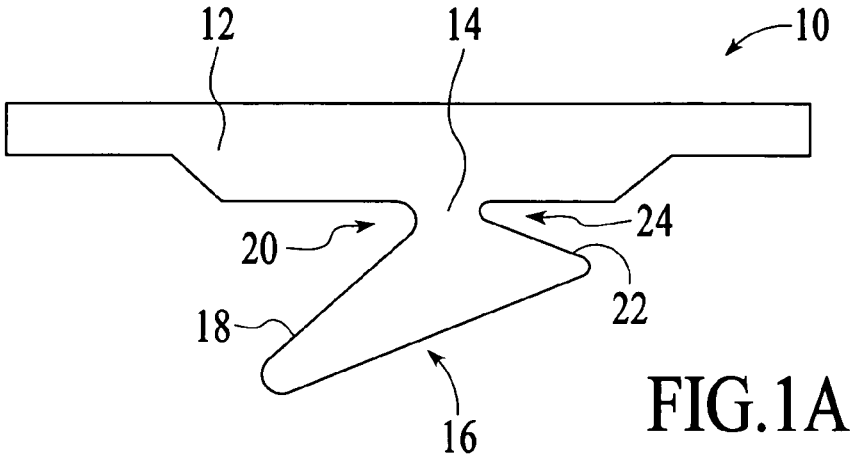
FIG. 1A is a cross sectional view of a hinged cleat in a relaxed position with no force applied to it.
Figure 1B:
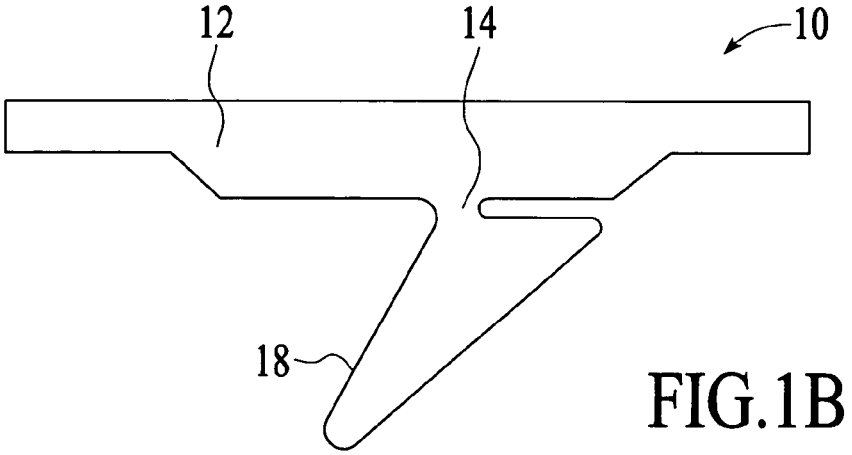
FIG. 1B is a cross sectional view of a hinged cleat in the cleating position during the golf swing
Figure 1C:
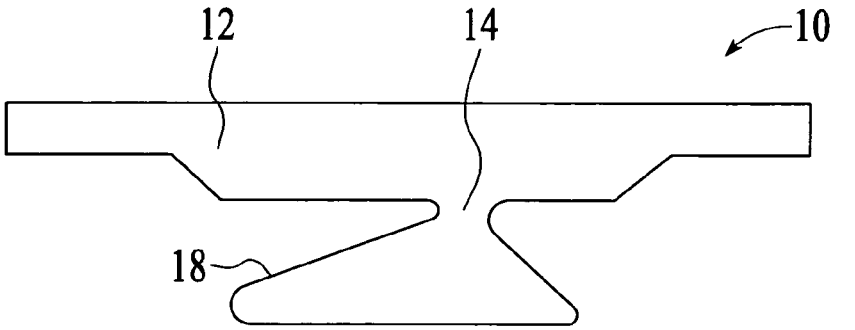
FIG. 1C is a cross sectional view of a hinged cleat in a position during walking or standing.

In the preferred embodiment of the invention, FIG. 1A shows a cross-sectional view of the flexible hinged cleat 10 in a normal relaxed position. The flexible hinged cleat is comprised of a base 12, a hinge section 14 and a traction section 16. The base, hinge section and traction section are formed as a unitary mechanism. The traction section is configured to provide a cleating action when the hinge section, formed of a flexible material, is flexed to extend the traction section as shown in FIG. 1B. The traction section 16, of FIG. 1A, is substantially triangular in shape, having a first side 18 forming a first angle 20 of approximately forty degrees with respect to the base 12. The traction section also has a second shorter side 22 forming a second angle 24 of approximately twenty-two degrees with respect to the base 12. The hinge section is capable of varying the first angle and second angle as required to perform a cleating action. FIG. 1B shows the hinge section has sufficient flexing capability to allow the second shorter side to make contact with the base. Making contact with the base prevents the traction section from extending beyond a substantially upright position, enabling a maximum cleating action to take place. FIG. 1C shows the hinge section 14 is capable of flexing in a manner that varies the first angle 20 and the second angle 24 so that a walking (or standing) position may be achieved. When in the walking position, negligible cleating action occurs.

Figure 2:
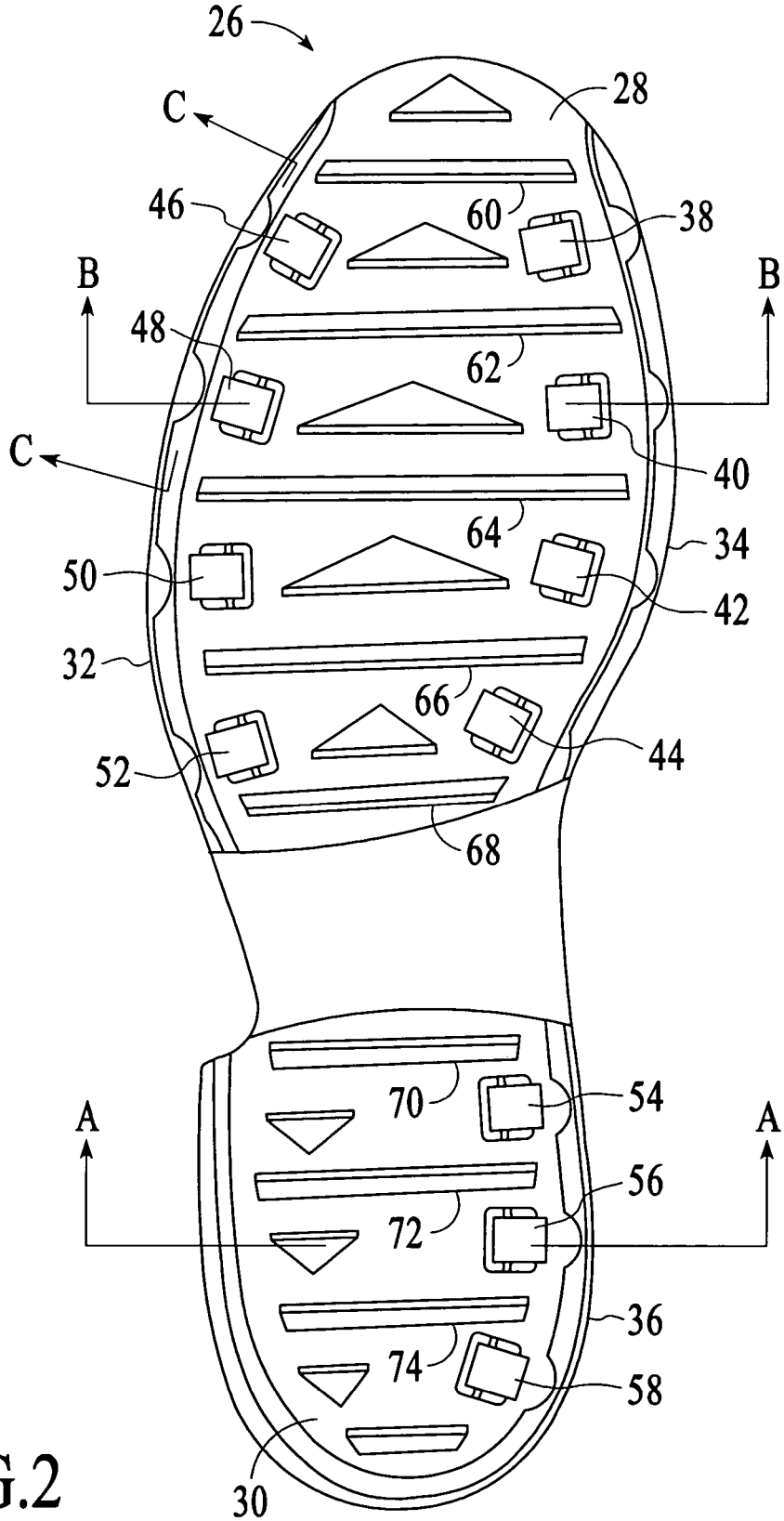
FIG. 2 is a bottom plan view of the outsole of a spikeless golf shoe, indicating section marks A-A, B-B and C-C.

In one embodiment, FIG. 2 shows the bottom view of an outsole 26 of a right shoe. The outsole 26 is comprised of front sole portion 28 and heel portion 30. One or more ridges 32 are formed on the "outer periphery" of the outsole, along the lateral side of the front sole portion, and one or more ridges 34 are formed on the "outer periphery" of the outsole along the medial side of the front sole portion. The outsole also includes one or more ridges 36 along the medial and lateral sides of heel portion 30. There are four flexible hinged cleats 38, 40, 42 and 44 in the front sole portion on the medial side facing in the lateral direction, and four flexible hinged cleats 46, 48, 50 and 52 in the front sole portion on the lateral side facing in the lateral direction. There are three flexible hinged cleats 54, 56 and 58 in the heel portion on the medial side facing in the medial direction.

A series of individual widthwise placed weight bearing structures 60, 62, 64, 66 and 68 is spaced apart from one another along the front sole portion 28 of outsole 26. Another series of individual widthwise placed weight bearing structures 70, 72 and 74 is spaced along the heel portion 30 of the outsole. The series of widthwise weight bearing structures in the front sole portion of the outsole has a rear face at approximately a ninety degree angle to the surface of the outsole and facing towards the rear of outsole, so as to provide traction to a golfer walking up an incline surface. The series of widthwise weight bearing structures in the heel portion 30 of the outsole has a front face at approximately a ninety degree angle to the surface of the outsole and facing towards the front sole portion of the outsole, so as to provide traction to a golfer walking down an inclined surface.

Figure 3:
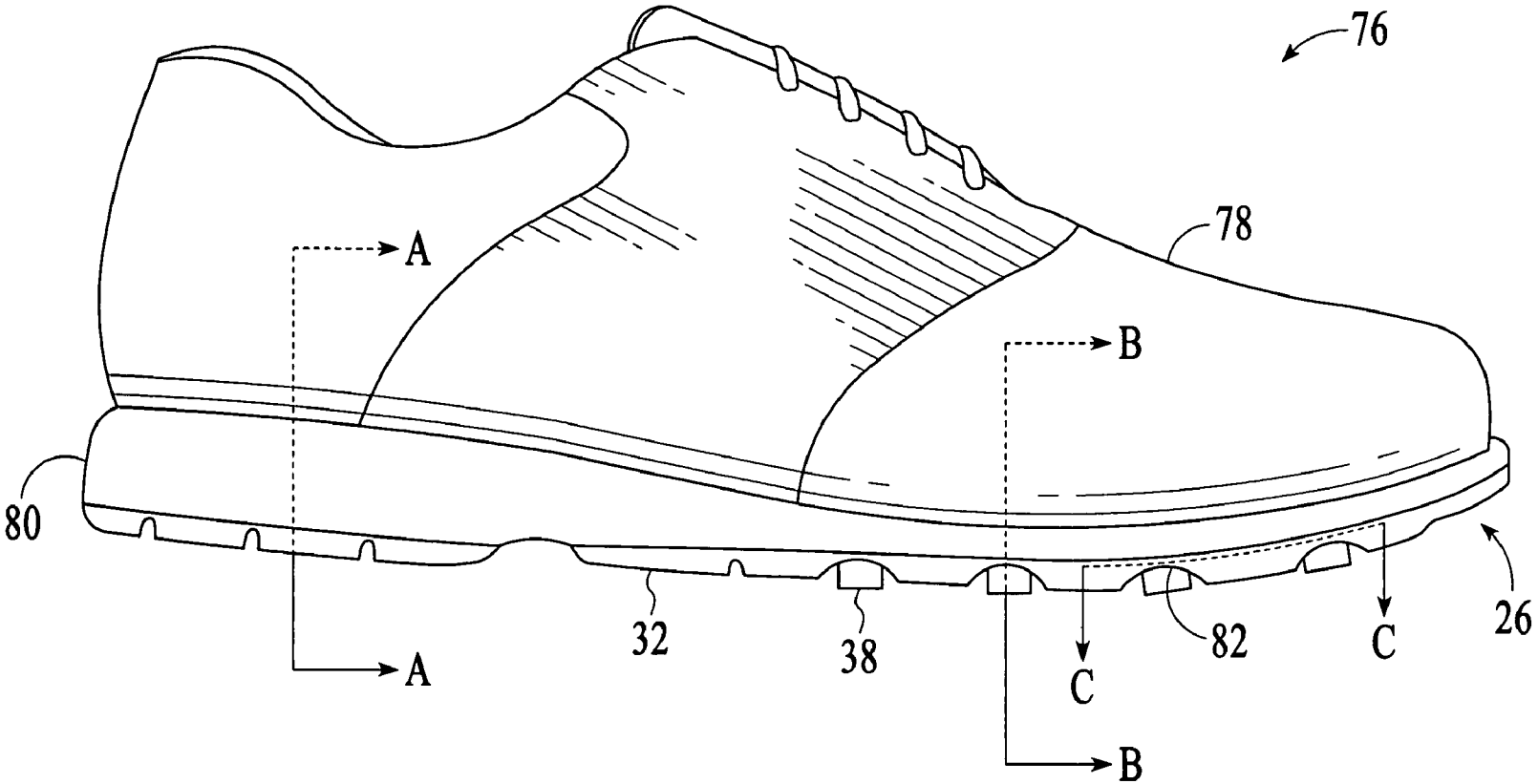
FIG. 3 is a side elevation view of a right spikeless golf shoe according to the present invention, indicating section marks A-A, B-B and C-C.

Referring now to FIG. 3, a side view of a spikeless golf shoe 76 according to the present invention is shown. The upper portion 78 of the golf shoe is typically fabricated from stitched fabric, leather, canvas, or other types of synthetic or natural materials. In some embodiments, the upper portion of the golf shoe also includes a middle portion, or midsole 80, typically made of a foam or rubber material. The spikeless golf shoe also includes a bottom outsole 26 which is attached to the midsole. Both the outsole portion and the midsole portion are attached to the upper portion. The outsole portion is the cleating system of FIG. 2 that includes ridges 32 and flexible hinged cleats 38-58. The flexible hinged cleats, shown in FIG. 2, provide the spikeless golf shoe with the ability to maintain traction during the golf swing, while minimizing the potential damage caused to the putting surface.

Figure 4:
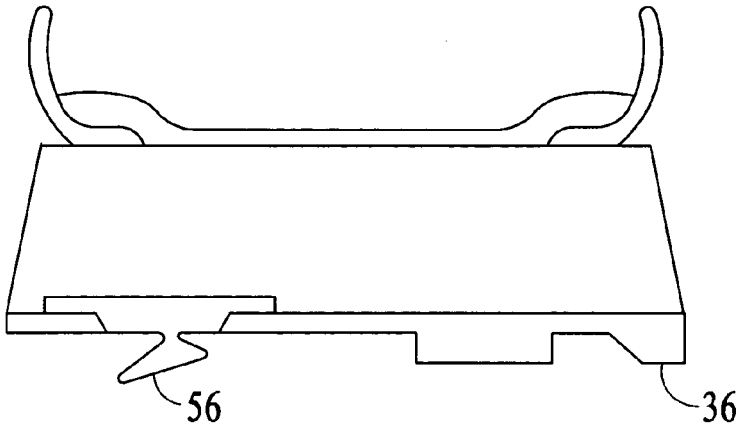
FIG. 4 shows a cross sectional view of a right spikeless golf shoe of FIGS. 1 and 2 at section mark A-A and the arrangement of hinged cleats.

FIG. 4 shows a cross section of the outsole 26 shown in FIG. 2 at section A-A on a right golf shoe. The flexible hinged cleat 56 is placed on the medial side of the outsole facing the inside of the shoe. During the golf swing, the heel section 30 of a right handed golfer's feet tend to slide inward (clockwise), as the front sole portion 28 tends to slide outward (clockwise). In FIG. 4, the flexible hinged cleat 56 is slightly taller than the ridges 36, so as to allow the flexible hinged cleat to penetrate the grass surface and flex outwardly for increased traction during the golf swing.

Figure 4A:
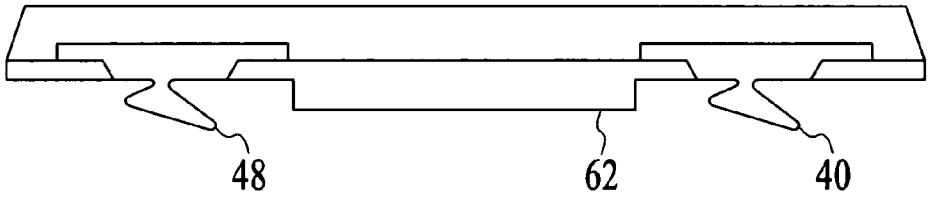
FIG. 4A is a cross sectional view of outsole 26 shown in the spikeless golf shoe in FIGS. 1 and 2 at section mark B-B and the arrangement of the hinged cleats.

FIG. 4A shows a cross section of outsole 26 shown in FIG. 3 at section B-B on a right spikeless golf shoe. The flexible hinged cleats 40 and 48 are positioned on the medial and lateral side of the front sole portion 28. The flexible hinged cleats are facing in the lateral direction of the outsole. During the golf swing, the front sole portion of a right handed golfer tends to slide outward in a clockwise direction. As the foot starts to slide in this manner, the flexible hinged cleats will extend in length to further penetrate the grass surface and thus provide traction during the golf swing. In this extended position, the flexible hinged cleats become approximately 60% taller than the weight bearing structures 60-68.

Figure 4B:
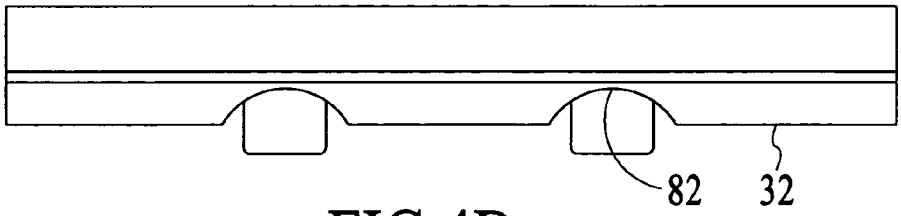
FIG. 4B is a cross section of outsole 26 shown in FIG. 1 at section C-C and the arrangement of the hinged cleats.

FIG. 4B is a cross section of the outsole 26 shown in FIG. 3 at section C-C. The ridges 32, 34 and 36, as shown in FIG. 2, have an opening 82 along the outer periphery adjacent to the flexible hinged cleats 46 and 48, so that the flexible hinged cleats can flex during the golf swing without any obstruction from the ridges. That is, openings should be properly positioned to allow the hinged cleats to operate properly.

Figure 5:
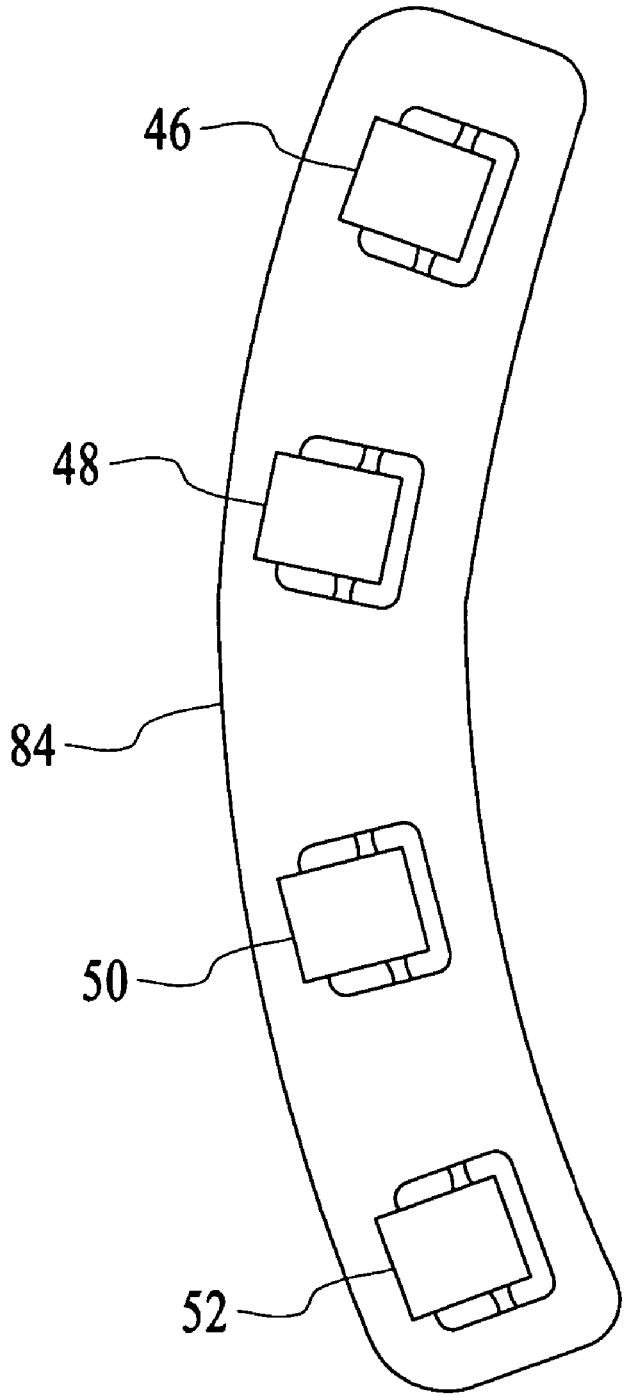
FIG. 5 is a top view of a pre-molded flexible hinged cleat strip used in the front portion of a right shoe as in FIG. 2.
Figure 6A:
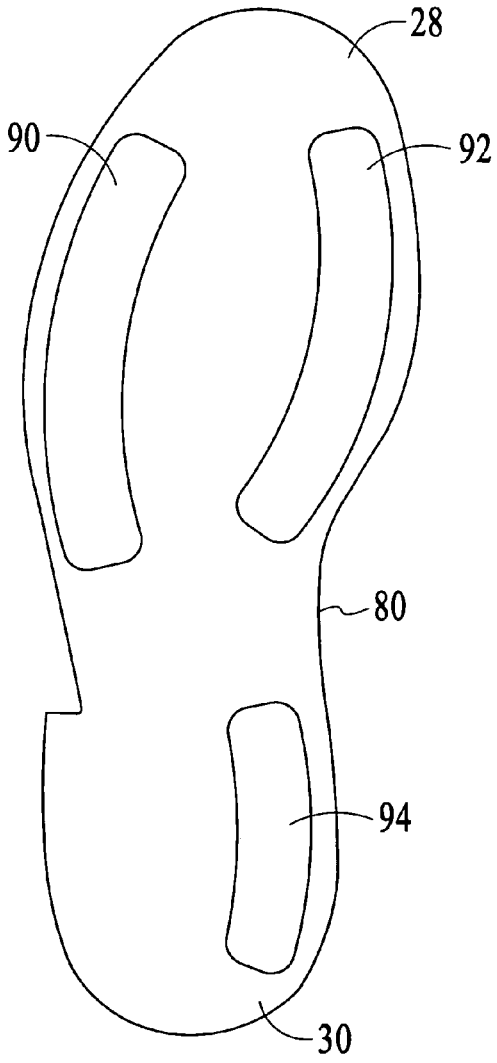
FIG. 6A is a bottom view of the midsole with two cavities in the front sole portion and one cavity in the heel. These cavities accept the pre-molded hinged cleat strips.
Figure 6B:
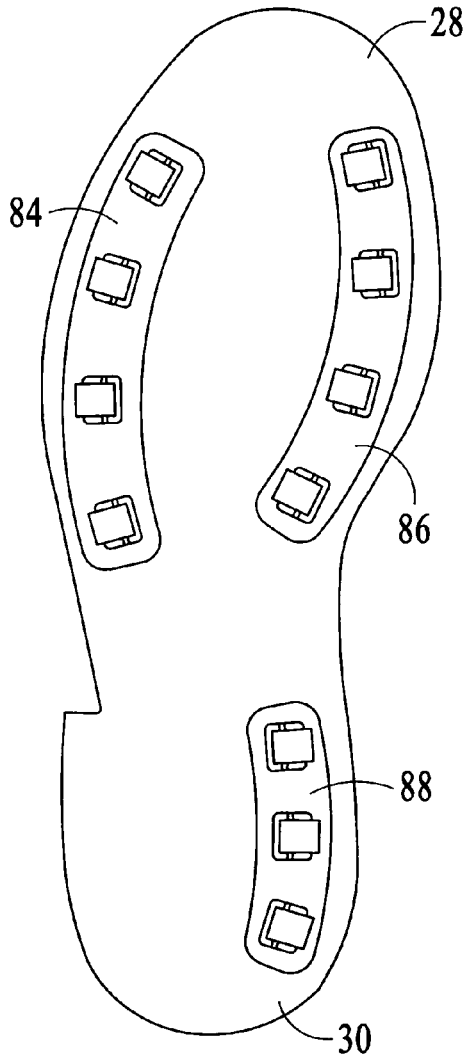
FIG. 6B is a view of FIG. 6A after the pre-molded hinged cleat strips have been attached.

In a further embodiment of the invention, FIGS. 5, 6A and 6B show the method of construction of a spikeless golf shoe 76. FIG. 5 shows a flexible hinged cleat strip 84 having a plurality of flexible hinged cleats 46, 48, 50 and 52. The flexible hinged cleat strip is a unitary structure made of urethane and formed by an injection molding process. Midsole 80 is formed, by known means, with three cavities 90, 92 and 94. FIG. 6A shows a midsole having a front sole portion 28 and a heel portion 30. The front sole portion has a lateral side cavity 90 and a medial side cavity 92. The heel portion has a medial side cavity 94. Each cavity is made to accept a flexible hinged cleat strip formed to fit into it. FIG. 6B depicts the midsole with the cavities filled with their respective flexible hinged cleat strip. In this embodiment, cavity 90 contains front sole lateral flexible hinged cleat strip 84. Cavity 92 contains front sole medial flexible hinged cleat strip 86, and cavity 94 contains heel medial flexible hinged cleat strip 88. The flexible hinged cleats are attached to the cavity by a mean known in the art. An outsole 26, formed to allow each flexible hinged cleat of the flexible hinged cleat strips to protrude through it, is fitted atop the midsole and attached by a known means.

What is claimed is:

1. A cleat for combination with a footwear comprising:

a base configured specifically for use on a footwear;

a hinge section extending outwardly from said base; and a traction section;

wherein said base, said hinge section and said traction section form a unitary footwear cleating mechanism, said hinge section having a small cross sectional area in a direction parallel to said base and being configured such that said traction section is hinged for rotation relative to a generally fixed axis, said traction section being configured so as to provide a cleating action when said hinge section is flexed to extend said traction section away from said base, said traction section being substantially triangular in shape to have a cross sectional area that is greater near said hinge section than a cross sectional area away from said hinge section and than said cross sectional area of said hinge section.

2. The cleat of claim 1 wherein said hinge section is formed of a flexible material that is operatively associated with a single said traction section, such that said traction section moves independently from any other said traction section.

3. The cleat of claim 2 wherein said traction section has a first side and a second shorter side, each of said first side and said second shorter sides being planar.

4. The cleat of claim 3 wherein said first side forms a first angle with respect to said base and said second shorter side forms a second angle with respect to said base.

5. The cleat of claim 4 wherein said hinge section is configured to accommodate said rotation of said traction section within a single plane about said generally fixed axis, thereby enabling varying said first angle and varying said second angle as required to provide said cleating action, said generally fixed axis being parallel to said base.

6. The cleat of claim 5 wherein said hinge section is capable of varying said first angle and varying said second angle until said second shorter side makes contact with said base so as to provide a maximum cleating action in which said traction section is extended from said base.

7. The cleat of claim 4 wherein said hinge section is capable of varying said first angle and said second angle as required to provide a walking position with negligible cleating action, wherein said first side is generally parallel to a surface contacting said traction section.

8. The cleat of claim 3 wherein said hinge section is capable of sustaining a first angle and sustaining a second angle as required to provide a relaxed position in response to an absence of force.

9. A cleating system comprising:

an outsole, said outsole having a front sole portion and a heel portion, said front sole portion and said heel portion each having a lateral side and a medial side;

a plurality of ridges disposed at an outer periphery of said lateral side and said medial side of both said front sole portion and said heel portion;

a first row of flexible hinged cleats disposed substantially parallel to said ridges of said lateral side of said front sole portion;

second row of flexible hinged cleats disposed substantially parallel to said ridges of said medial side of said front sole portion; and a third row of flexible hinged cleats disposed substantially parallel to said ridges of said medial side of said heel portion;

wherein each said flexible hinged cleat has a hinge section and a single traction section that is connected to operate independently of traction sections of other said flexible hinged cleats, each said flexible hinged cleat being configured to enable said single traction section to pivot only about a generally fixed axis within a particular single plane of rotation at said hinge section relative to said outsole upon a sideways movement of said outsole, such that each said flexible hinged cleat extends in length upon an application of lateral force with said sideways movement of said outsole.

10. The cleating system of claim 9 wherein said plurality of ridges of said front sole portion and said heel portion has an open area adjacent to each said flexible hinged cleat of said plurality of flexible hinged cleats, each said flexible hinged cleat being oriented relative to said open area to which it is adjacent such that each said single traction section pivots about said axis that is generally perpendicular to said open area.

11. The cleating system of claim 10 wherein each said flexible hinged cleat is configured so as to provide a cleating action upon a rotation of said single traction section at said hinge section of said flexible hinged cleat, said traction section being substantially triangular in shape, said hinge section being configured to establish said axis about which said traction section pivots.

12. The cleating system of claim 11 wherein each said flexible hinged cleat is configured so as to provide a walking position with negligible said cleating action in response to force that is primarily perpendicular to said outsole.

13. The cleating system of claim 12 wherein said walking position is one in which said substantially triangular shaped traction section of said flexible hinged cleat has a major contact surface generally parallel to said outsole, so as not to alter a putting surface upon contact therewith.

14. The cleating system of claim 11 wherein each said flexible hinged cleat is configured so as to provide a relaxed position in which said hinge section is in a relaxed condition.

15. The cleating system of claim 9 further comprising a plurality of weight bearing structures disposed amid said plurality of ridges of said front sole portion and said heel portion, said weight bearing structures providing support when a user is walking or at rest.

16. The cleating system of claim 15 wherein said flexible hinged cleats do not extend beyond the apex of said weight bearing structures, when said user is walking or at rest.

17. A method of forming a spikeless golf shoe comprising:

providing a midsole having a front sole portion and a heel portion, said front sole portion and said heel portion each having a lateral side and a medial side, said midsole having at least one cavity;

providing at least one flexible hinged cleat strip having a plurality of flexible hinged cleats, including inserting each said flexible hinged cleat strip into an associated said cavity, each flexible hinged cleat including a traction section and a hinge section which enables localized rotation of said traction section;

providing an outsole configured to fit atop said midsole; and connecting said midsole and outsole to said spikeless golf shoe such that said flexible hinged cleats extend through at least one opening through said outsole;

wherein providing said at least one flexible hinged cleat strip includes forming said hinge section to have a small cross sectional area in a direction parallel to a base of said at least one flexible hinged cleat strip, each said hinge section being configured such that said traction section is hinged for rotation relative to a generally fixed axis, said traction section being configured so as to provide a cleating action when said hinge section is flexed to extend said traction section away from said base, said traction section being substantially triangular in shape to have a cross sectional area that is greater near said hinge section than a cross sectional area away from said hinge section and than said cross sectional area of said hinge section.

18. The method of claim 17 wherein said midsole is formed with a front sole portion lateral side cavity, a front sole portion medial side cavity and a heel portion medial side cavity.

19. The method of claim 18 wherein providing each said flexible hinged cleat strip includes forming a unitary structure having a substructure and a plurality of said flexible hinged cleats.

20. The method of claim 19 wherein forming said flexible hinged cleat strip includes using an injection molding process.

* * * * *

UNITED STATES PATENT AND TRADEMARK OFFICE

CERTIFICATE OF CORRECTION

PATENT NO. : 7,386,948 B2
APPLICATION NO. : 10/959766
DATED : June 17, 2008
INVENTOR(S) : Jeffrey A. Sink It is certified that error appears in the above-identified patent and that said Letters Patent is hereby corrected as shown below:

Column 5, lines 66-67, in claim 1, delete "for rotation relative to" and insert --to restrict rotation only within a single plane about--.

Column 6, lines 3-5, in claim 1, delete "being substantially triangular in shape to have" and insert --having three exterior surfaces which are arranged to define a shape that is substantially triangular, said substantially triangular shape having--.

Column 6, line 40, in claim 9, after "an outsole" insert --having a top surface and a bottom surface--; Column 6, line 59, in claim 9, delete "enable" and insert --restrict--; Column 6, lines 62-63, in claim 9, after "said outsole" insert --said generally fixed axis being substantially parallel to said bottom surface--.

Column 7, line 5, in claim 10, delete "perpendicular" and insert --parallel--.

Column 7, line 9, in claim 11, before "rotation" delete "a".

Column 8, lines 21-22, in claim 17, delete "being substantially traingular in shape to have" and insert --having three exterior surfaces which are arranged to define a shape that is substantially triangular, said substantially triangular shape having--.

Signed and Sealed this

Twenty-sixth Day of August, 2008

JON W. DUDAS
*Director of the United States Patent and Trademark Office*